US006230725B1

(12) United States Patent
Ko

(10) Patent No.: US 6,230,725 B1
(45) Date of Patent: May 15, 2001

(54) UMBRELLA MAIN STRETCHER FORMED OF A CARBON FIBER ROD AND ALUMINUM ALLOY PORTION

(76) Inventor: Chin-Sung Ko, No. 27-1, Lane 188, Sec. 3, Chin Mar Rd., Changhua (TW)

( * ) Notice: Subject to any disclaimer, the term of this patent is extended or adjusted under 35 U.S.C. 154(b) by 0 days.

(21) Appl. No.: 09/303,601

(22) Filed: May 3, 1999

(51) Int. Cl.[7] ..... A47B 19/10
(52) U.S. Cl. ..... 135/31; 135/27; 135/253
(58) Field of Search ..... 135/31, 32, 29

(56) References Cited

U.S. PATENT DOCUMENTS 5,502,624 * 3/1996 Tu ..... 362/102
5,553,634 * 9/1996 Yang ..... 135/25.3
5,931,175 * 8/1999 Lin et al. ..... 135/31
6,062,242 * 5/2000 Lin ..... 135/31
6,095,169 * 8/2000 Lin et al. ..... 135/31

* cited by examiner

*Primary Examiner*—Robert Canfield
(74) *Attorney, Agent, or Firm*—Rosenberg, Klein & Lee

(57) ABSTRACT

The present invention discloses an aluminum alloy umbrella stretcher structure having light weight and improved strength of resisting being broken by strong wind. The improvement comprises providing a carbon fiber segment on the second main umbrella stretcher. In other words, the second main umbrella stretcher according to the invention is composed of an aluminum alloy segment integrated with a carbon fiber segment effectively to enhance the strength of umbrella stretchers, avoiding being broken when the umbrella canopy is reversed by strong wind.

1 Claim, 5 Drawing Sheets

UMBRELLA MAIN STRETCHER FORMED OF A CARBON FIBER ROD AND ALUMINUM ALLOY PORTION

BACKGROUND OF THE INVENTION

A conventional umbrella stretcher system comprises a first main umbrella stretcher (1), a second main umbrella stretcher (2), a rear rib (3), a support stretcher (4), a secondary umbrella stretcher (5) and a flexible rib (6) as shown in FIG. 1. The first main umbrella stretcher (1) and the second main umbrella stretcher (2) and the support stretcher (4) are made of aluminum alloy and have a U-shaped cross section so as to receive other umbrella stretcher members when opening or closing the umbrella. The secondary umbrella stretcher (5) has a flat plate-like aluminum alloy body, which smoothes the operation of the umbrella stretcher system. The reason that these stretcher members are made of alloy aluminum is its light weight, which can provide convenience in use and a suitable strength to support the operation of an umbrella. Such a design does not reveal any significant shortcoming in a normal environment. However, in an area where wind is strong, such a stretcher structure will be easily damaged or broken because the umbrella canopy might be reversed when it bears strong winds The reversal wind force will easily cause the secondary main umbrella stretcher (2) to be damaged or broken by irreversible bending. It ends the service life of the umbrella. This is a major defect of aluminum alloy umbrellas.

In view of the above problem, the primary object of the invention is to provide an aluminum alloy umbrella stretcher structure featured in light weight and improved strength of resisting strong wind, which can be elastically restored without being damaged or broken when the umbrella canopy is reversed. Now the features and advantages of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
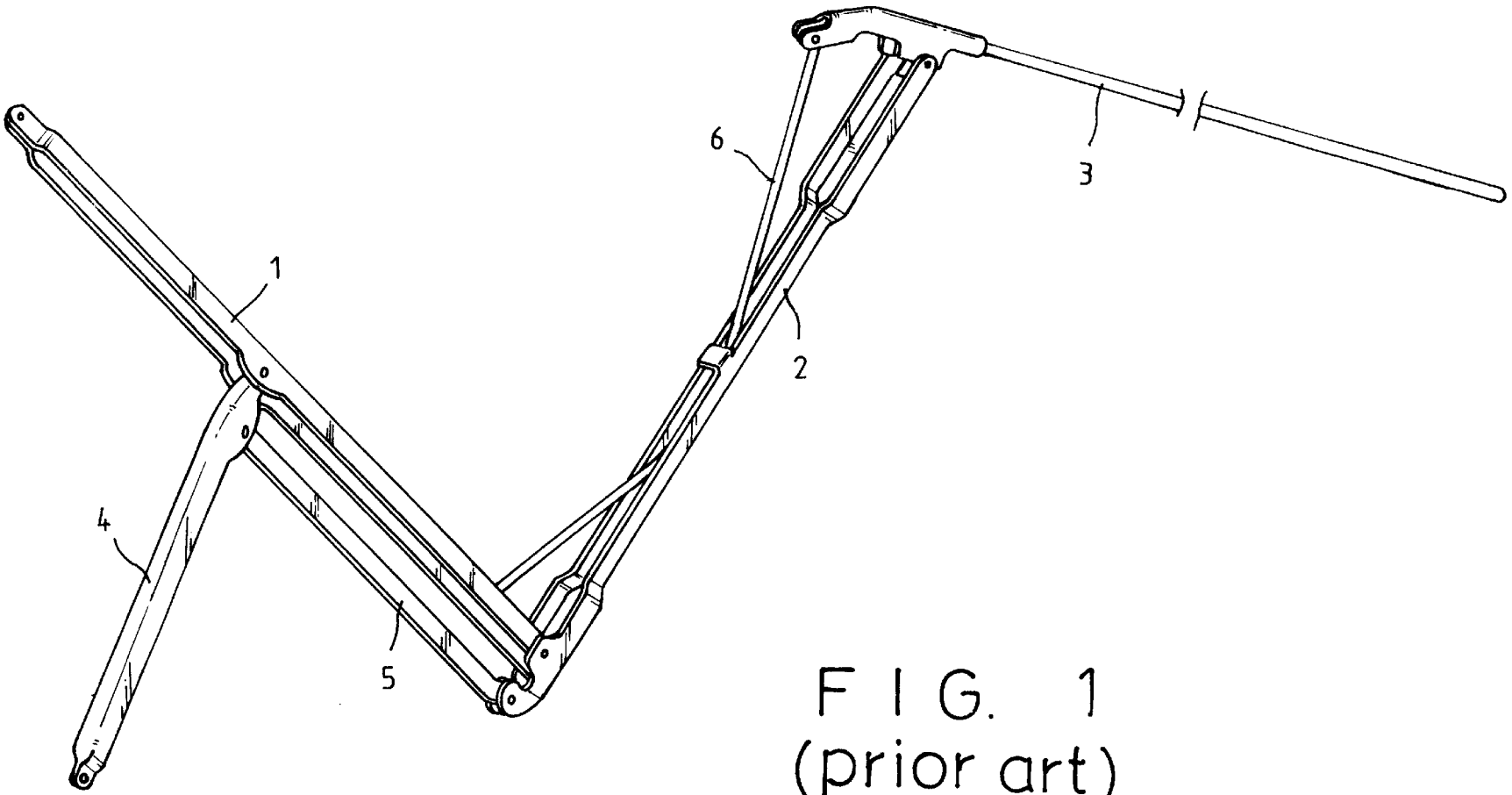
FIG. 1 (prior art)
FIG. 1 is a perspective view of a prior art umbrella stretcher system.
Figure 2:
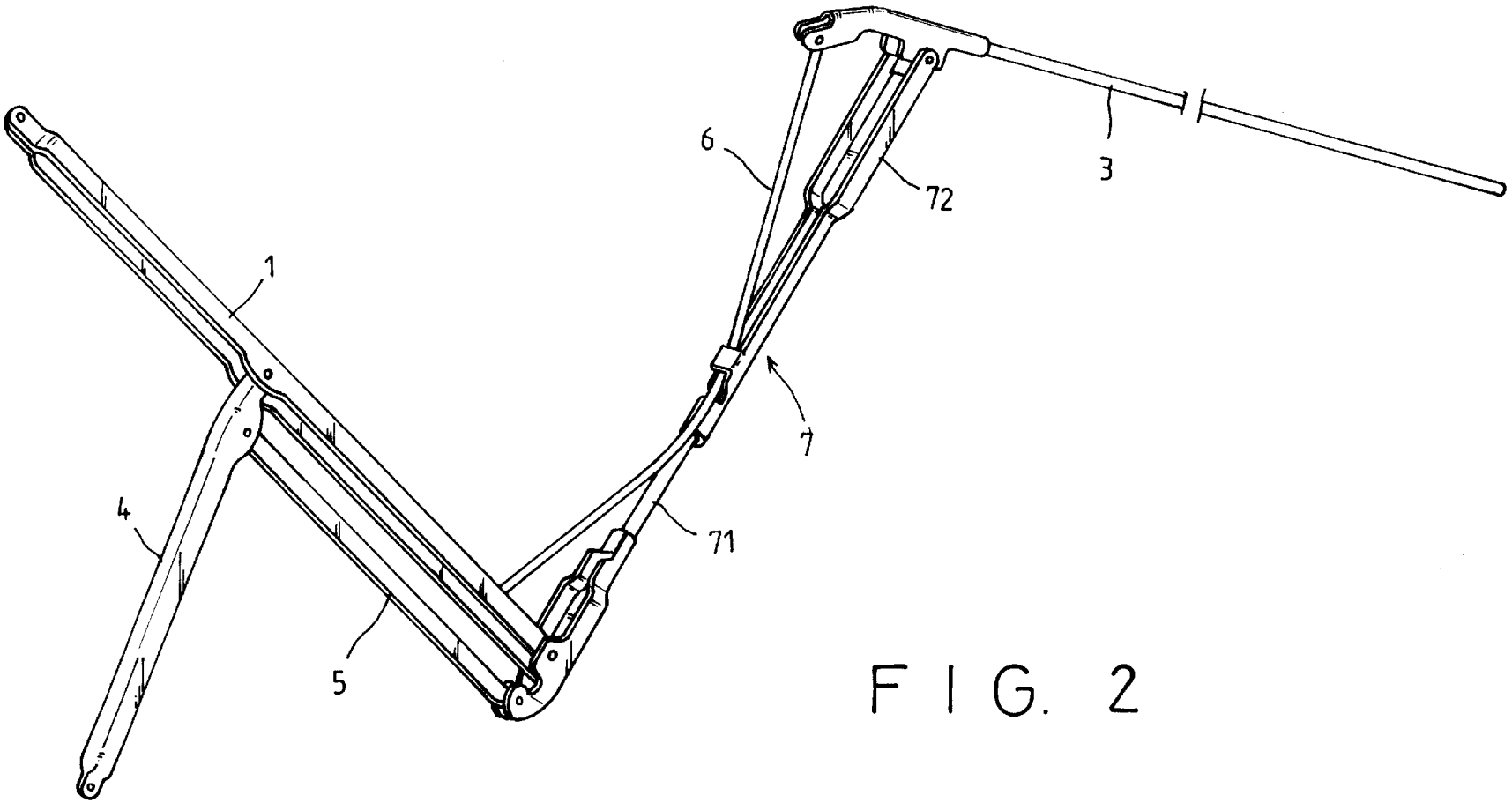
FIG. 2 is a perspective view of an embodiment of an umbrella stretcher system according to the invention.
Figure 3:
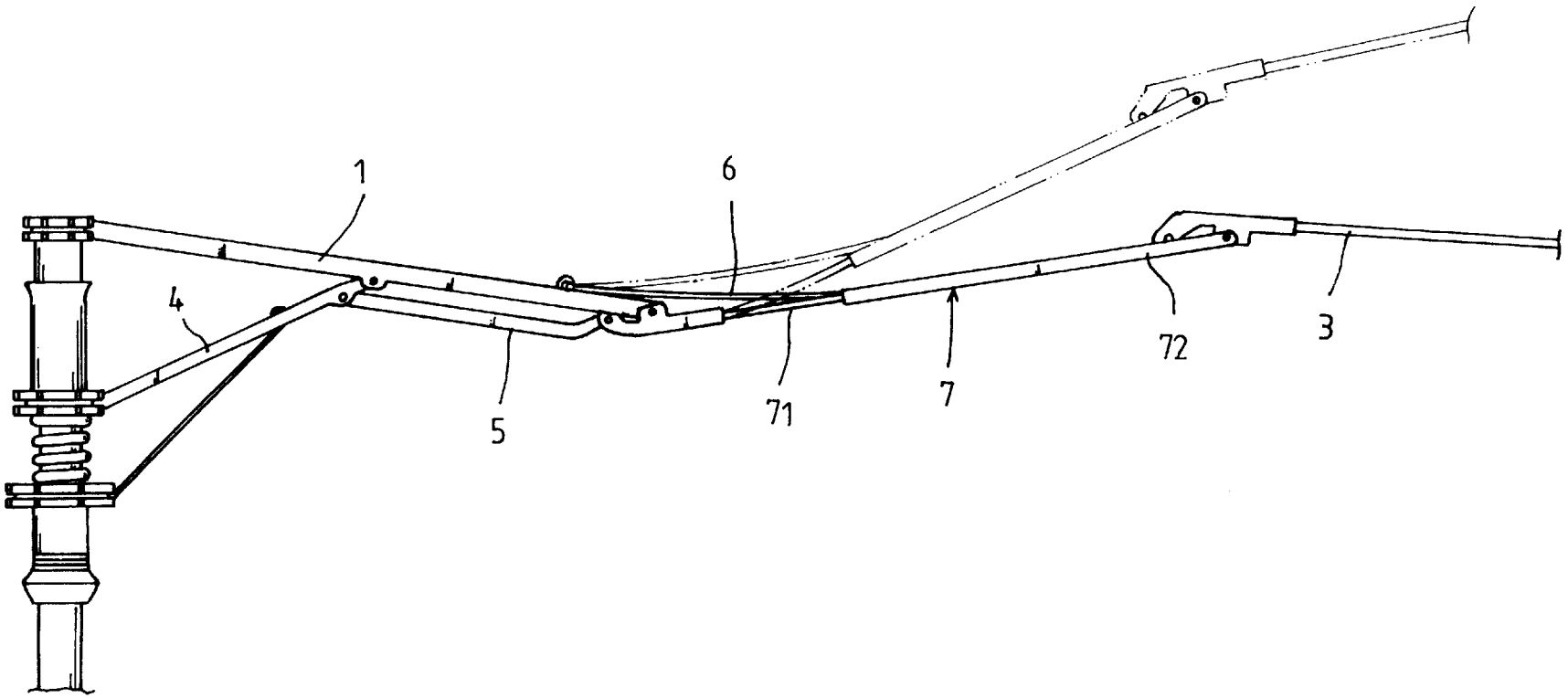
FIG. 3 is a plan view showing the movements of the umbrella stretcher system of FIG. 2.

Referring to FIGS. 2 and 3, the invention comprises the elements of an average umbrella stretcher system. It includes a first main umbrella stretcher (1), a second main umbrella stretcher (7), a rear rib (3), a support stretcher (4), a secondary umbrella stretcher (5) and a flexible rib (6) interconnected with each other. The improvement according to the invention is made on the secondary main umbrella stretcher (7), which is easier to be damaged as the umbrella canopy is reversed than other members of the umbrella stretcher system. The improvement uses a carbon fiber rod (71) integrated with other aluminum alloy portions (72) having a U-shaped cross section to form a second main stretcher (7). Thus the second main stretcher according to the invention consists of a portion of carbon fiber and other portions of aluminum alloy so that it can provide a better strength of resisting strong wind. When the umbrella bears wind force as shown in FIG. 3 and umbrella stretcher members are forced to bend to the opposite direction, the carbon fiber rod (71) will take the most portion of the bending force. When wind stops, it can restore to the original state without being broken. Thus the stretcher structure can get rid of the shortcoming of a prior art aluminum alloy stretcher.

Figure 4:
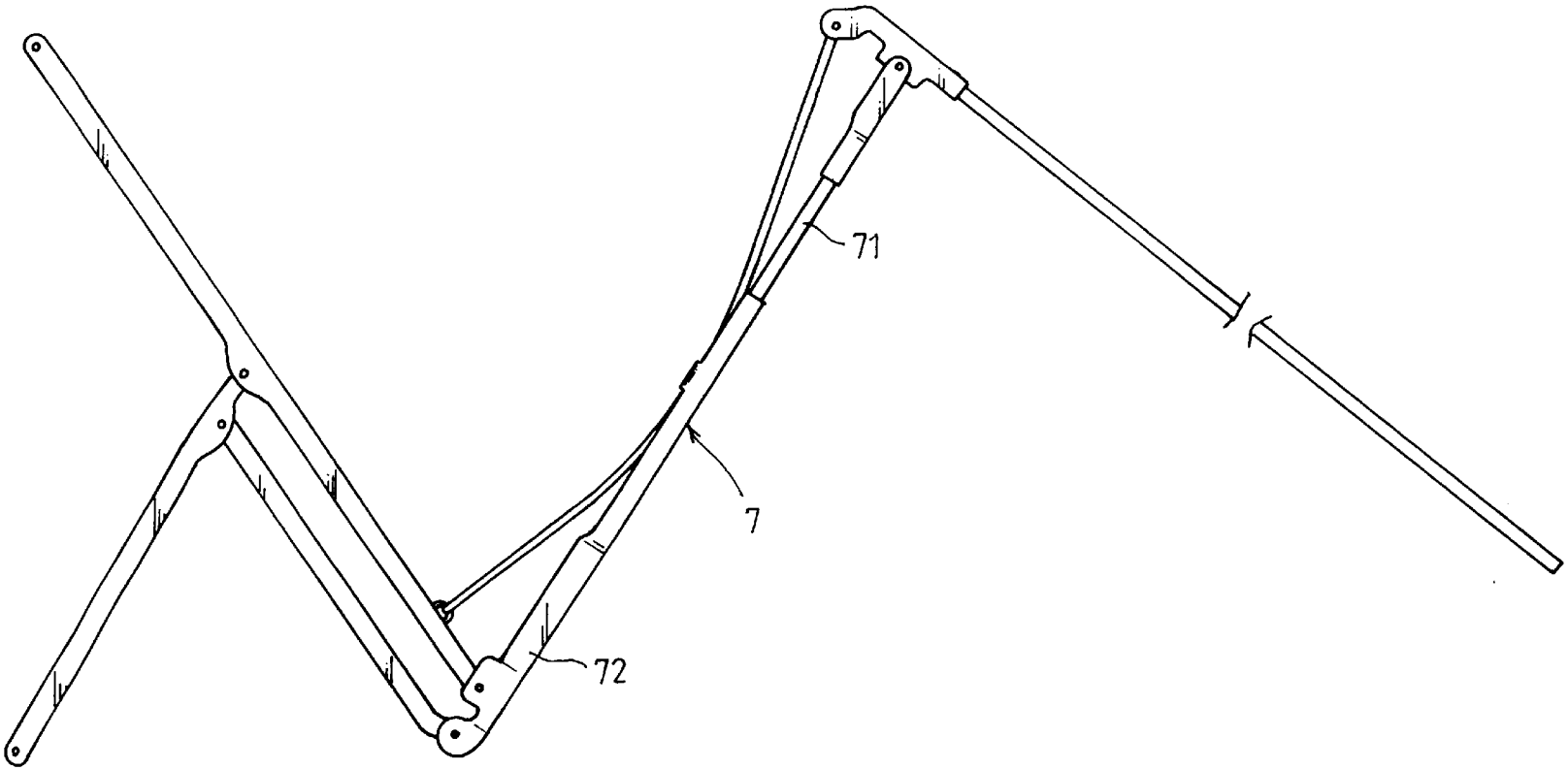
FIG. 4 shows a variation of the umbrella stretcher of FIG. 2 according to the invention.
Figure 5:
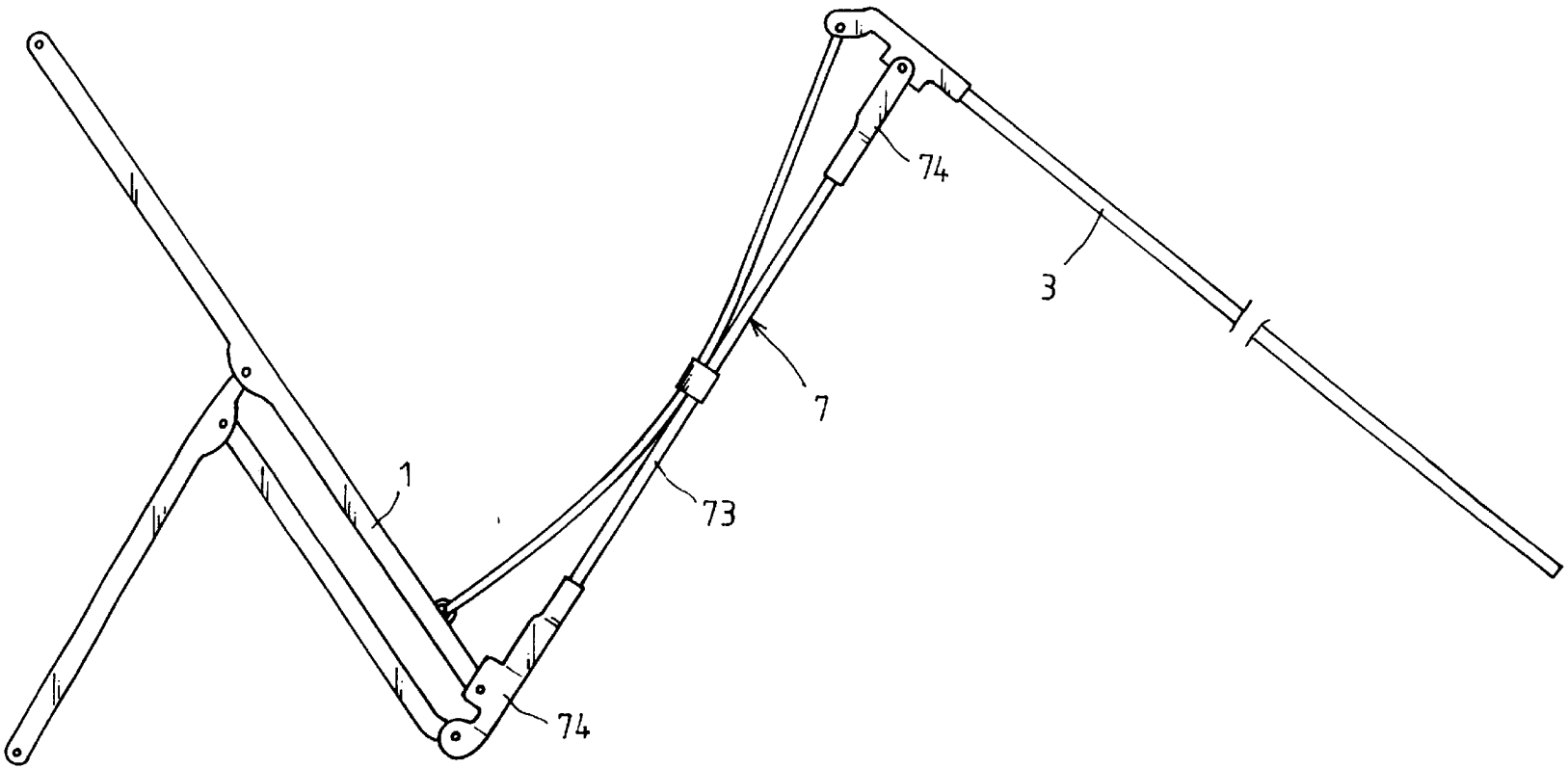
FIG. 5 shows another variation of the umbrella stretcher of FIG. 2 according to the invention.

Although the preferred embodiments of the invention have been disclosed for illustrative purposes, those skilled in the art will readily recognize that numerous modifications, additions and substitutions are possible, without departing from the spirit and scope of the invention as disclosed in the accompanying claims. For example, the position of the carbon fiber rod (71) of the second main umbrella stretcher (7) may be changed as shown in FIG. 4. The length of the carbon fiber rod (71) may vary or even the second main umbrella stretcher can be made up of two carbon fiber rods (74) coupled with each other by an aluminum alloy pivotal connector (73) as shown in FIG. 5.

From the described above, the improved umbrella stretcher structure according to the invention indeed promotes the performance of an umbrella stretcher system and can achieve the expected effect. Thus the invention has the essence of a patent and we hereby apply for a grant of a patent.

What is claimed is:

1. An umbrella stretcher structure for resisting wind induced damage, comprising:

a first main stretcher having a first end pivotally coupled to an umbrella shaft;

a support stretcher having one end pivotally coupled to an intermediate portion of said first main stretcher and an opposing end pivotally coupled to a runner on the umbrella shaft;

a second main stretcher having a pivotal coupling member on a first end thereof pivotally coupled to a second end of said first main stretcher, said second main stretcher including a carbon fiber rod coupled to said pivotal coupling member on one end thereof and integrally joined to an aluminum alloy portion on an opposing end, said aluminum alloy portion having a U-shaped cross-sectional contour;

a secondary umbrella stretcher coupled on one end to said support stretcher adjacent to its coupling to said first main stretcher and coupled on an opposing end to said pivotal coupling member adjacent its coupling to said first main stretcher;

a rear rib pivotally coupled to said aluminum alloy portion of said second main stretcher; and, a flexible rib coupled between said rear rib and said first main stretcher, wherein displacement of said umbrella stretcher structure by wind forces flexes said carbon fiber rod to a greater degree than said aluminum alloy portion, said carbon fiber rod subsequently applying a bias force to return said umbrella stretcher structure's position.

* * * * *